US009526312B2

(12) United States Patent
Lee et al.

(10) Patent No.: US 9,526,312 B2
(45) Date of Patent: Dec. 27, 2016

(54) RAZOR CARTRIDGE DISPENSER

(71) Applicant: HF Global, Inc., New York, NY (US)

(72) Inventors: Stuart Harvey Lee, Forest Hills, NY (US); Jochen Schaepers, New York, NY (US)

(73) Assignee: HARRY'S, INC, New York, NY (US)

( * ) Notice: Subject to any disclaimer, the term of this patent is extended or adjusted under 35 U.S.C. 154(b) by 0 days.

(21) Appl. No.: 14/720,119

(22) Filed: May 22, 2015

(65) Prior Publication Data

US 2015/0342319 A1 Dec. 3, 2015

Related U.S. Application Data

(60) Provisional application No. 62/005,077, filed on May 30, 2014.

(51) Int. Cl.
*A45D 27/22* (2006.01)
*B26B 21/24* (2006.01)

(52) U.S. Cl.
CPC ..... *A45D 27/225* (2013.01); *B26B 21/24* (2013.01)

(58) Field of Classification Search
CPC ..... B65D 83/10; A45D 27/225; A45D 27/22; A45D 27/24; B26B 21/24; A61B 19/0262; A61B 19/0288; A61B 2019/0263
USPC ..... 206/354, 352, 353, 355, 359, 357, 358
See application file for complete search history.

(56) References Cited

U.S. PATENT DOCUMENTS

| | | | | | |
|---|---|---|---|---|---|
| 2,070,430 | A | * | 2/1937 | Wallenthin | A45D 27/22 206/228 |
| 3,835,532 | A | | 9/1974 | Petrillo | |
| D249,637 | S | * | 9/1978 | Iten | D9/736 |
| 4,173,285 | A | * | 11/1979 | Kiraly | B65D 83/10 206/356 |
| D256,996 | S | * | 9/1980 | Kiraly | D9/736 |
| D256,998 | S | | 9/1980 | Motta | |
| 4,285,428 | A | | 8/1981 | Beddall et al. | |
| D312,568 | S | | 12/1990 | Gray | |
| D316,962 | S | | 5/1991 | Gray | |
| D324,299 | S | | 3/1992 | Bowman | |
| D353,764 | S | | 12/1994 | Ho | |
| D366,611 | S | | 1/1996 | Poisson | |
| 5,518,114 | A | * | 5/1996 | Kohring | B65D 83/10 206/352 |
| D397,290 | S | | 8/1998 | Petricca | |
| 5,946,805 | A | | 9/1999 | Oldroyd | |
| D417,146 | S | | 11/1999 | Gosling et al. | |
| 6,041,926 | A | * | 3/2000 | Petricca | A45D 27/225 206/356 |
| D430,013 | S | | 8/2000 | Shurtleff et al. | |
| 6,405,864 | B1 | * | 6/2002 | Streich | A45C 5/00 206/373 |
| 6,499,595 | B1 | | 12/2002 | Petricca | |
| 6,845,866 | B2 | | 1/2005 | Zieger | |

(Continued)

*Primary Examiner* — Steven A. Reynolds
(74) *Attorney, Agent, or Firm* — Florek & Endres PLLC

(57) ABSTRACT

A razor cartridge dispenser for retaining, dispensing and receiving razor cartridges, the cartridges having a blade portion mounted to a handle connection portion, the dispenser including first and second cooperating members joined by a connection such that the first and second cooperating members can be adapted from a closed configuration to an open configuration, each of said first and second cooperating members comprising one or more compartments for retaining a cartridge.

19 Claims, 5 Drawing Sheets

(56) References Cited

U.S. PATENT DOCUMENTS

| | | | | |
|---|---|---|---|---|
| 6,886,690 | B2 | 5/2005 | Petricca | |
| D522,382 | S | 6/2006 | Wonderley | |
| D531,518 | S | 11/2006 | Ramm et al. | |
| D558,063 | S | 12/2007 | Kohring | |
| 7,413,078 | B2 | 8/2008 | Fischer et al. | |
| D579,347 | S | 10/2008 | Kohring | |
| D596,047 | S | 7/2009 | Wonderley | |
| 7,631,757 | B2 | 12/2009 | Petricca | |
| D620,376 | S | 7/2010 | Peyser et al. | |
| D630,109 | S | 1/2011 | Wonderley | |
| D630,526 | S * | 1/2011 | Wonderley | D9/736 |
| D643,751 | S * | 8/2011 | Wonderley | D9/736 |
| 8,584,848 | B1 * | 11/2013 | Lee | B65D 83/10 206/353 |
| 8,966,811 | B2 * | 3/2015 | Tremper | A01K 97/06 206/315.11 |
| 2008/0201957 | A1 * | 8/2008 | Apprille | A45D 27/225 30/124 |

* cited by examiner

RAZOR CARTRIDGE DISPENSER

FIELD OF THE INVENTION

The present invention relates to the field of shaving razor cartridge dispensers and more particularly to the field of razor cartridge dispensers for holding multiple razor cartridges.

BACKGROUND OF THE INVENTION

Shaving razors have evolved over the years from a straight edge razor, having a razor edge that needed to be sharpened from time to time, to a safety razor having a unitary handle and head, the head being opened to receive replaceable blades, to a handle and razor cartridge system, where a razor cartridge having integrated blades and a handle connection member is attached to a handle having a cartridge connection member.

With the advent of replaceable blades, there next came the need to keep a store of razor blades for replacement when used blades lost their edge. With safety razors, which used substantially flat single or double edge blades, new blades were individually wrapped in paper, stacked and placed in a cardboard box with end flaps for removing a wrapped blade. The flat nature of the safety razor blades made wrapping in paper and storage of a number of wrapped blades in a small cardboard box very easy.

However, once disposable razor blade cartridges came into use, there was a need to store the blade cartridges in a dispenser where the cartridge could be attached to or removed from the handle quickly and easily. These dispensers were most often formed of plastic and provided separate compartments for individually retaining individual blade cartridges.

One example of a cartridge dispenser is found in U.S. Pat. No. 3,835,532, which shows a number of compartments into which individual blade cartridges are stored, having lugs to maintain the cartridges in the compartments. When a blade cartridge is to be removed from the dispenser, the user attaches the handle to the cartridge and pulls up on the handle to overcome the force of the lug on the blade portion of the cartridge, releasing the cartridge from the dispenser. The user can replace a used cartridge into the dispenser by pushing the used cartridge into an empty compartment, overcoming the force of the lug when pushing down, and then releasing the cartridge from the handle.

Blade cartridge dispensers have changed with changes in blade cartridges. For example, cartridges have changed to include not just the blade portion but also a handle connection portion that is pivotably attached to the blade portion. In keeping, some cartridge dispensers have been designed to provide that the handle connection portion of the cartridges is covered by a divider separating cartridges and by side walls of the dispenser that extend above the handle connection portion of the cartridge.

For example, as shown in U.S. Pat. No. 6,041,926, blade cartridge dispensers have been described to include two piece structures that form compartments for containing the handle connection portions as well as the blade portions of the cartridge. The structure shown in U.S. Pat. No. 6,041,926 further describes a latch that engages the top of the connection portion of the cartridge, such that a cam on the handle separates the latch from the handle connection portion for removal of the cartridge from the dispenser.

However, there is needed a razor cartridge dispenser which conveniently and efficiently retains, dispenses and accepts razor blade cartridges that is limited in size and contains its own packaging.

SUMMARY OF THE INVENTION

The present invention is directed to a razor cartridge dispenser for retaining, dispensing and receiving razor cartridges, the cartridges having a blade portion mounted to a handle connection portion, the dispenser comprising first and second cooperating members joined by a connection member such that the first and second cooperating members can be adapted from a closed configuration to an open configuration, each of said first and second cooperating members comprising one or more compartments for retaining a cartridge.

When the first and second cooperating members are in a closed configuration, the handle connection portion of a first cartridge retained in the first cooperating member preferably nests in an area corresponding to that above the blade portion and in front of the handle connection portion of a second cartridge retained in the second cooperating member and, conversely, the handle connection portion of the second cartridge retained in the second cooperating member nests in an area corresponding to that above the blade portion and in front of the handle connection portion of the first cartridge retained in the first cooperating member. This nested configuration permits the total height of the dispenser to be less than the total height of two cartridges.

In its preferred embodiment, the connection member joining the first and second cooperating members comprises one or more hinges about which the first and second cooperating members can pivot with respect to one another. Preferably, the one or more hinges are disposed substantially parallel to the direction of the blades of the blades in the razor cartridge.

The one or more hinges can be any suitable type, including living hinges, however, the one or more hinges most preferably comprise a mechanical hinge such as a butterfly hinge, a barrel hinge, a piano hinge, etc., including combinations thereof, with one of the hinge elements associated with the first cooperating member and the other hinge element associated with the second cooperating member. Notwithstanding, any suitable connection member can be used to hold one side of the first and second cooperating members in folding or pivoting relation to one another.

Most preferably, however, the one or more hinges have rounded surfaces when the dispenser is in the open configuration, so that there are no protruding corners for the blades to catch when the razor cartridge is being removed from the dispenser. The hinges preferably extend across the entire end of the dispenser, again to eliminate protruding corners, including edges or convex shapes that the blades can catch, and further preferably incorporate a ramped wall at the adjacent side walls to further ensure that the blades will not catch the ends of the hinge. In this regard, the ramped wall should be on the side walls at the end of the cooperating member that houses the blade cartridge oriented with the handle connection portion closest to the hinge to ensure that the blade does not catch the end of the hinge member.

It is also preferred, but not required, that at least one of the first and second cooperating members include a closure member for retaining the first and second cooperating members in the closed configuration. Preferred closure members may be one or more snap locks, clips, clasps, magnets, or the like and may have a release element, such as a tab or grip patch, to assist in releasing the closure element to rotate the first and second cooperating members into the open configuration. Most preferred is a snap lock including a protrusion on one of the first and second cooperating members that engages a recess or aperture in the other of the first and second cooperating members to hold the cooperating members in a closed configuration.

In selecting the connection member, it is most preferred that the connection permits the first and second cooperating members to close fully, creating a container for the blade cartridges therein, as well as to open to a sufficient degree to allow the first and second cooperating members to lie flat on a horizontal surface. Additionally, it is preferred that the compartments for retaining the cartridges are oriented such that the handle connection portions of all of the cartridges in the first and second cooperating members are facing the same direction when the first and second cooperating members are lying flat in the open configuration. Such an orientation has the synergistic effect of both maximizing the area in the closed dispenser and creating a consistent attachment position for the user.

The compartments of the first and second cooperating members preferably comprise a front wall, which may have front wall stops, against which the front of the blade portion rests, a rear wall having a top surface, upon which the handle connection portion of the cartridge rests, a floor with one or more floor supports, on which the bottom of the blade portion rests, and side walls with at least one catch, preferably a catch on each side wall, to engage the blade portion of the cartridge for retaining the cartridge in the compartment. Of course, the front wall of one compartment may be the opposite side of the rear wall of the adjacent compartment when two or more compartments are formed in each of the first and second cooperating members, or the front wall one of the first and second cooperating members.

The one or more catches in each compartment may be any suitable member that holds the cartridge in the compartment. Most preferred, however, are one or more cammed lugs protruding from one or more of the side walls that engage the top surface of the cartridge being held therein. In the most preferred embodiment, the lugs are on the free end of a spring arm cut out from the side wall, and cammed on both the top and bottom surfaces, to provide improved capture and release of the cartridge within the compartment. A suitable alternative, however, may be a fixed rib on one or both of the side walls of the compartments that frictionally engage an elastomeric material such as a thermoplastic resin on the sides of the blade portion of the cartridge.

The first and second cooperating members are complimentary members that combine to create a closed, unitary package. They preferably have similar or complementary dimensions, so as to create a closed container when in the closed configuration. In the most preferred embodiment, the first and second cooperating members form a clamshell, with the distinction that the connection member is at the front of one of the first and second cooperating members and at the back of the other when in the open position. As such, the dispenser is preferably configured to provide storage for multiples of two cartridges, i.e., 2 cartridges, 4 cartridges, 6 cartridges, etc., to maximize the nesting of one cartridge with a conversely oriented cartridge. Moreover, the dispenser can be formed with adjacent rows of compartments, in addition to or as an alternative to columns of compartments, if desired.

The first and second cooperating members may have additional features, depending on the desired characteristics. More particularly, they may include drain and aeration or ventilation holes, indicia, etc., however, such features are not necessary to the dispenser of the present invention.

Although the first and second cooperating members may be formed of any suitable material, a polymer material which can be injection molded into the cooperating members is preferred. More particularly, a polystyrene material is most preferred, although a polypropylene material may be a suitable option depending on the features selected for the dispenser.

In keeping, the razor cartridge dispenser of the present invention preferably provides a package that can be opened, closed and reopened to remove new blades retained in the two or more compartments or to reinsert used blades into empty compartments, maximizing the use of space in the dispenser as well as limiting the overall size of the dispenser.

BRIEF DESCRIPTION OF THE DRAWINGS

The present invention will be better understood when considered in view of the attached drawings, in which like reference characters indicate like parts. The drawings, however, are presented merely to illustrate the preferred embodiment of the invention without limiting the invention in any manner whatsoever.

DETAILED DESCRIPTION OF THE PREFERRED EMBODIMENT

Figure 1:
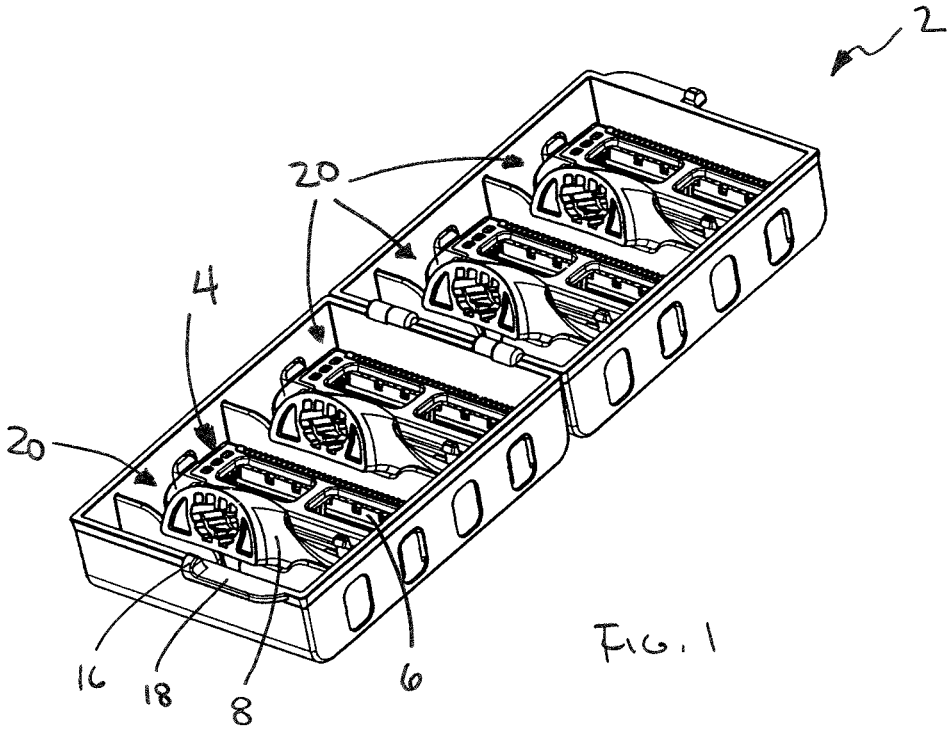
FIG. 1 is a perspective view of the preferred embodiment of the razor cartridge dispenser of the present invention in its open configuration, with cartridges retained therein.

As shown in the drawings, the present invention is directed to a razor cartridge dispenser 2 for retaining, dispensing and receiving razor cartridges 4, the cartridges 4 having a blade portion 6 pivotably mounted to a handle connection portion 8 for connecting the cartridge 4 to a handle (not shown). The dispenser 2 includes a first cooperating member 10 and a second cooperating member 12 joined by a connection member, shown as a hinge 14, for rotating the first connection member 10 in relation to the second cooperating member 12.

Figure 2:
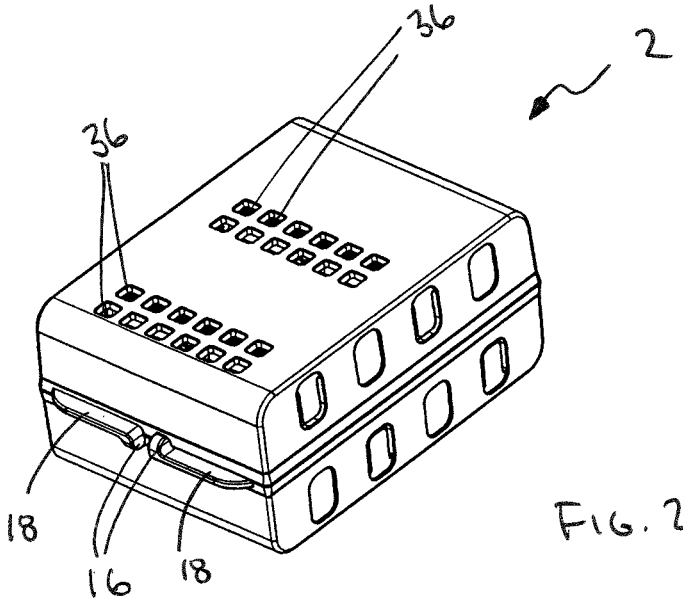
FIG. 2 is a perspective view of the preferred embodiment of the razor cartridge dispenser of the present invention in its closed configuration.
Figure 3:
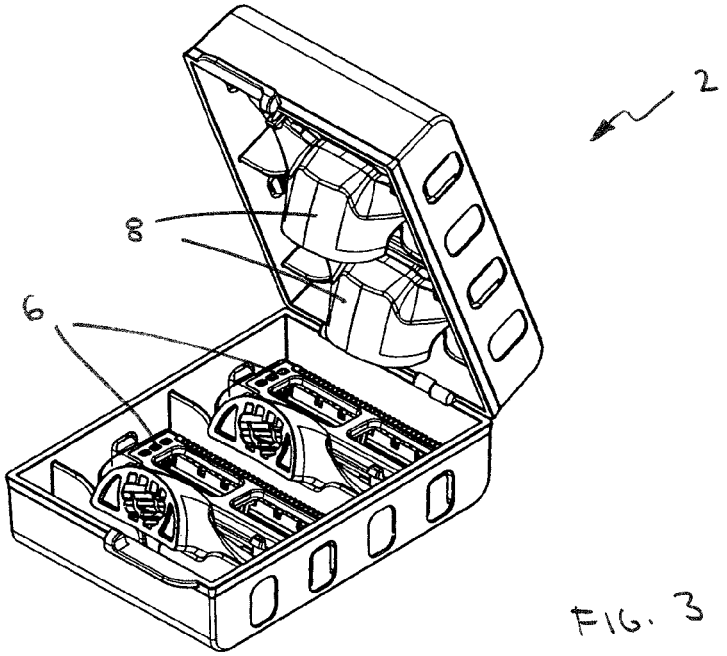
FIG. 3 is a perspective view of the preferred embodiment of the razor cartridge dispenser of the present invention in a partially open configuration, with cartridges retained therein.
Figure 4:
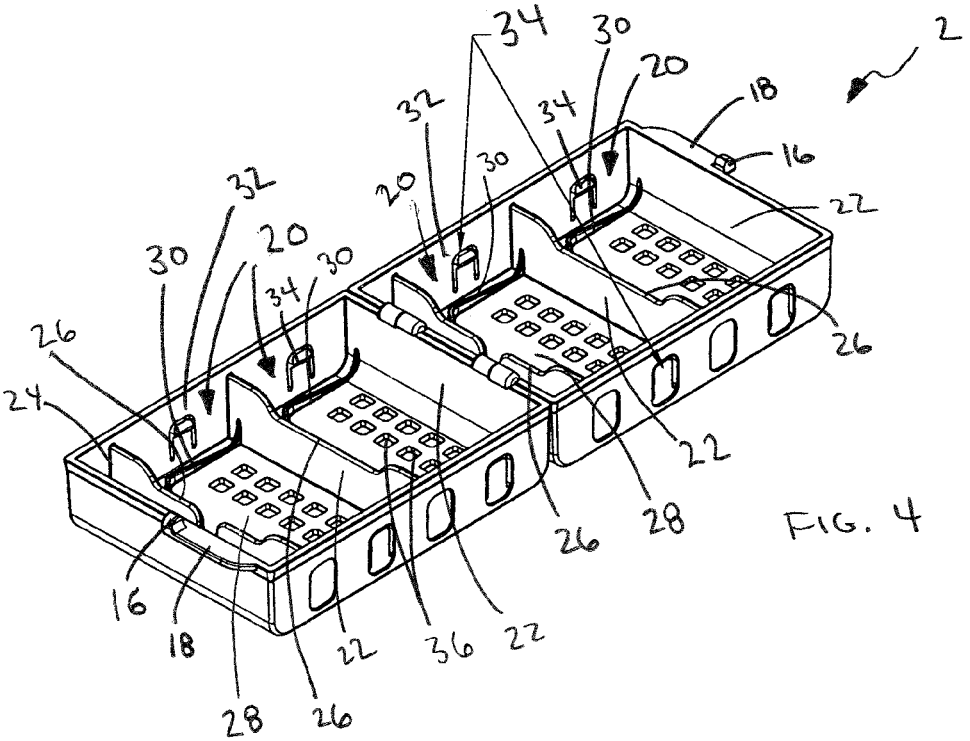
FIG. 4 is a perspective view of the preferred embodiment of the razor cartridge dispenser of the present invention in its open configuration, shown empty.
Figure 5:
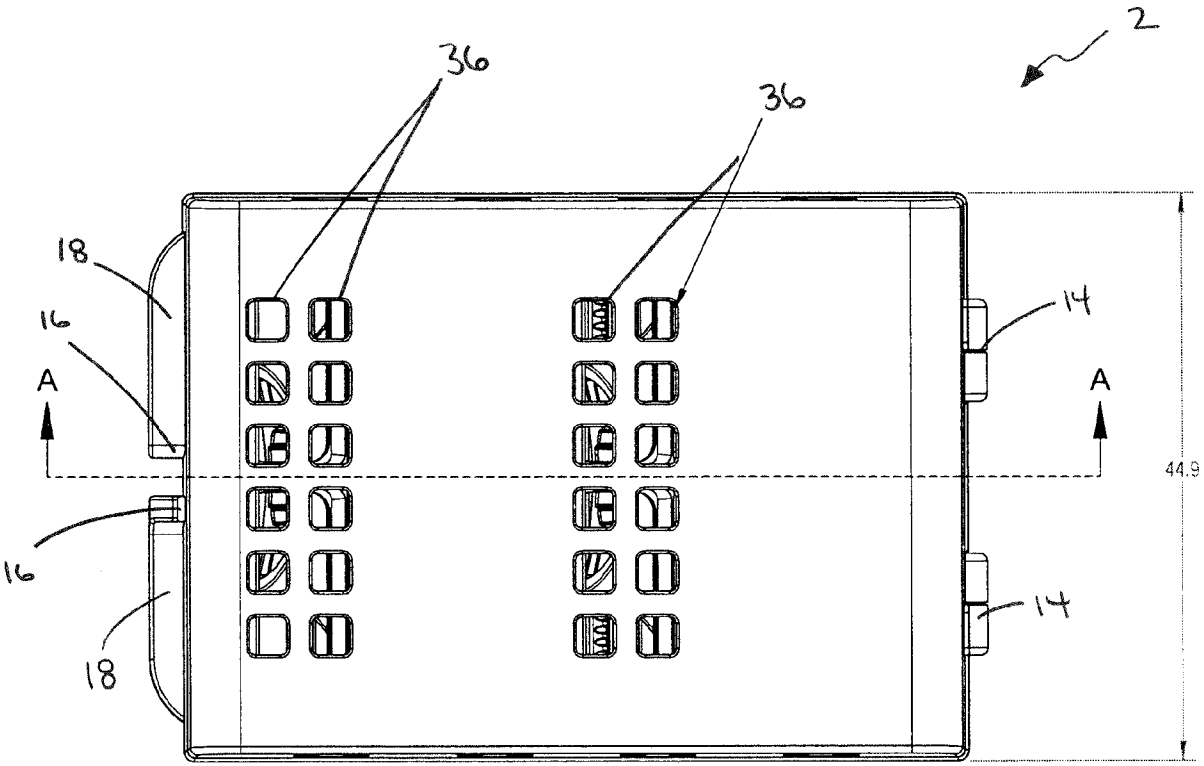
FIG. 5 is a top plan view of the preferred embodiment of the razor cartridge dispenser of the present invention, with dimensions in millimeters.
Figure 6:
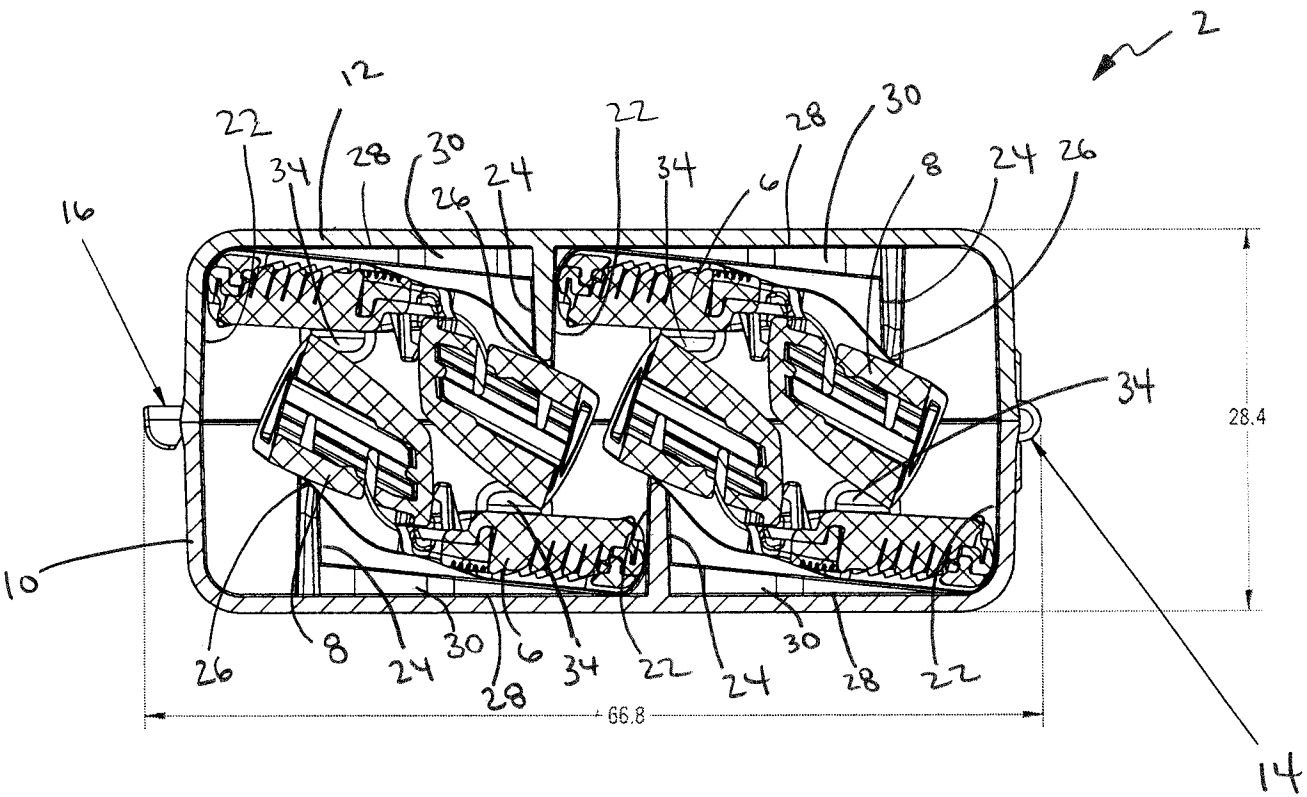
FIG. 6 is a cross section of the preferred embodiment of the razor cartridge dispenser of the present invention through line A-A of FIG. 5, with dimensions in millimeters.
Figure 7:
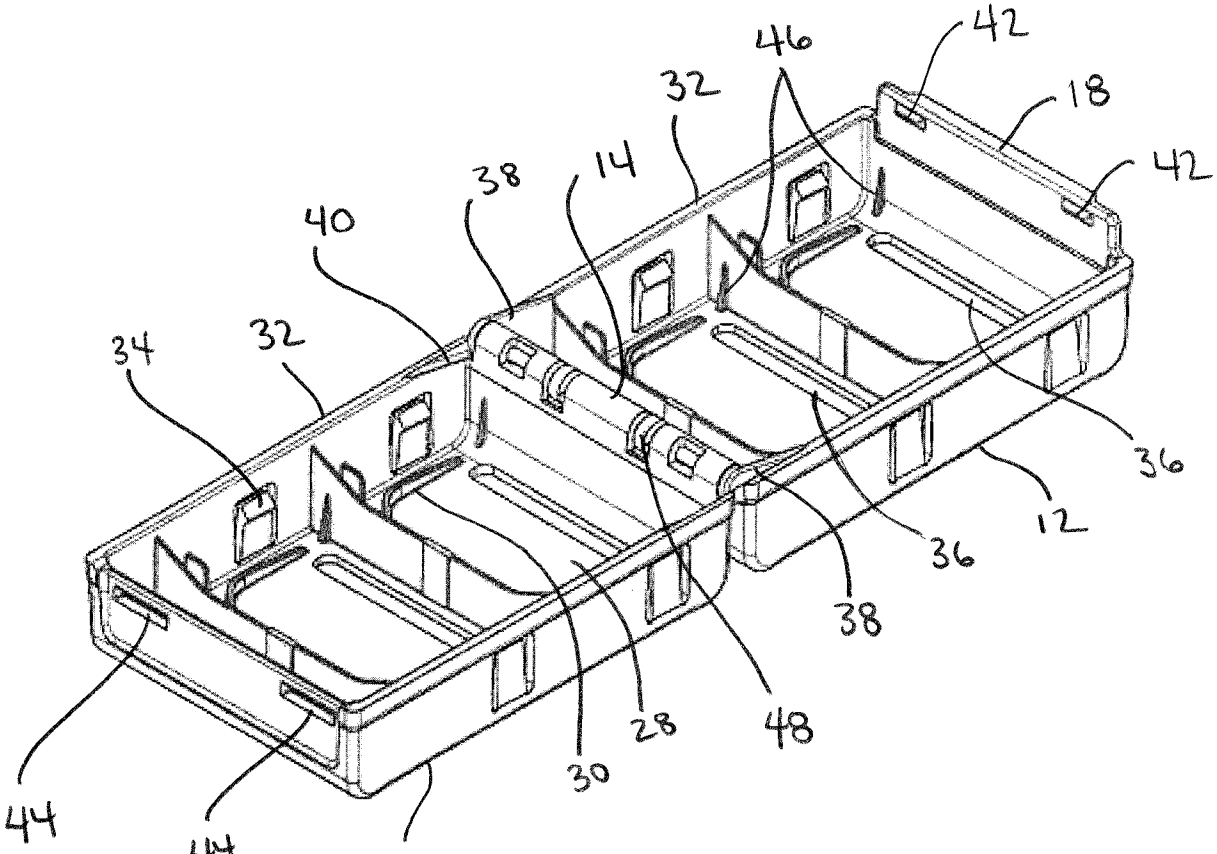
FIG. 7 is a perspective view of a preferred hinge for use with the razor cartridge dispenser of the present invention.

The connection member 14 permits the first and second cooperating members 10, 12 to be adapted between an open configuration, as shown in FIGS. 1 and 7, to a closed configuration, as shown in FIG. 2, including a partially open configuration, as shown in FIG. 3. A closure member, shown as a snap closure 16 with one or more release members shown as a tab 18 on one or both of the opposed first and second cooperating members 10, 12 in FIGS. 1-6, and as cooperating detents 42 and receivers 44 with a release tab 18 in FIG. 7, is preferably included to maintain the cooperating members 10, 12 in the closed configuration.

Each of said first and second cooperating members 10, 12 comprise one or more compartments 20, wherein each of the compartments 20 is adapted to retain an individual cartridge. The compartments 20 preferably comprise a front wall 22, which may include front wall stops 46 as shown in FIG. 7, against which the front of the blade portion 6 rests, a rear wall 24 having a top surface 26, upon which the handle connection portion 8 of the cartridge 4 rests, a floor 28 with one or more floor supports 30, on which the bottom of the blade portion 8 rests, and side walls 32 with at least one catch 34, preferably a catch 34 on each side wall, to contact the top of the blade portion 8 for retaining the cartridge 4 in the compartment 20.

As shown in the attached drawings, and best shown in FIG. 6, the front wall 22 of one compartment 20 may be the opposite side of the rear wall 24 of the adjacent compartment 20 when two or more compartments 20 are formed in each of the first and second cooperating members 10, 12, or the outer wall one of the first and second cooperating members 10, 12.

The catches 34 in each compartment are preferably cammed lugs protruding from one or more of the side walls 32, which engage the top surface of the blade portion 6 of the cartridge 20 being held. In the most preferred embodiment, the lugs are on the free end of a spring arm cut out from the side wall, and cammed on both the top and bottom surfaces, to provide improved capture and release of the cartridge 4 within the compartment 20.

When the first and second cooperating members 10, 12 are in a closed configuration, as best shown in FIG. 6, the handle connection portion 8 of a first cartridge 4 retained in the first cooperating member 10 nests in an area corresponding to that above the blade portion 6 and in front of the handle connection portion 8 of a second cartridge 4 retained in the second cooperating member 12. Conversely, the handle connection portion 8 of the second cartridge 4 retained in the second cooperating member 12 nests in an area corresponding to that above the blade portion 6 and in front of the handle connection portion 8 of the first cartridge 4 retained in the first cooperating member 10.

This nested configuration permits the total interior height of the dispenser 2 to be less than the height of two separate cartridges 4, and preferably about the height of two blade portions 6 and one handle connection portion 8 (see FIG. 6).

As shown in FIG. 1, the compartments 20 for retaining the cartridges 4 are thus preferably oriented with the handle connection portions 8 of all of the cartridges 20 in the first and second cooperating members 10, 12 facing the same direction when the first and second cooperating members 10, 12 are in the open configuration. This orientation both maximizes the area in the closed dispenser 2 and creates a consistent handle attachment position for the user.

When using this preferred orientation, however, the orientation of the razor cartridges 4 on one of the cooperating members 10, 12 will be such that rearward removal of the cartridge will create the potential that the blades will move across the hinge 14. As such, the preferred hinge 14, as shown in FIG. 7, extends along the entire end of each of the cooperating members 10, 12 of the dispenser 2, so that when the dispenser 2 is in the open configuration there are no protruding corners, including any convex shapes, for the blades to catch on when the cartridge 4 is being removed from the dispenser 2.

The hinge 14 also preferably incorporates ramped walls 38 at the side walls 32 of the cooperating member 12 adjacent the hinge 14 to further ensure that the blades will not catch the hinge 14. The ramped walls 38 should extend above the side walls 32 of the cooperating member 12 to the height of the open hinge 14, at the end of the cooperating member 12 that houses the blade cartridges 4 oriented with the handle connection portion 8 closest to the hinge 14. This placement and height is designed to ensure that the blades do not catch the ends of the hinge 14.

As further shown in FIG. 7, the ramped walls 38 may be less than the full thickness of the cooperating member side wall 32, by creating a ramped wall cutout 40 on the opposed cooperating member side wall 32. This permits the side walls 32 of the cooperating members 10, 12 to have side walls 32 of uniform height.

Additionally, the hinge 14 may include stop members (not shown) to limit the cooperating members 10, 12 to an open configuration of about 180° and/or fillers 48 in the open hinge 14 to further eliminate corners for the blades to catch.

Any suitable number of compartments 20 can be used, generally in multiples of two so that a cartridge 4 on the first cooperating member 10 has a converse cartridge 4 on the second cooperating member 12. Notwithstanding, it is preferred that the dispenser 4 have between two and six compartments 14, with four compartments, i.e., two on the first cooperating member 10 and two on the second cooperating member 12, being most preferred. Moreover, the dispenser 2 can be formed with adjacent rows of compartments 20, in addition to or as an alternative to columns of compartments 20 shown in the preferred embodiment, if desired.

The first and second cooperating members 10, 12 are complimentary members, with similar dimensions, so as to create a "clamshell" container when in the closed configuration. In such embodiment, the distinction in the cooperating members 10, 12 is that, when the open dispenser 2 is laid flat, the connection member 14 is at the back of the first cooperating member 10 and at the front of the second cooperating member 12.

Additionally, one or both of the first and second cooperating members 10, 12 may have added features, depending on the desired characteristics. For example, as best shown in FIGS. 2, 4, 5 and 7, one or both of the cooperating members 10, 12 may include drain and/or ventilation holes 36, indicia, etc. When drainage and/or ventilation holes are used, it is preferred that they be formed in the floor 28 of the compartment 20 nearer the front walls 22 of the compartments 20.

The dispenser 2 can be made of any suitable material including but not limited to a polymer material that may be injection molded to create the first and second cooperating members 10, 12. Most preferably, however, the first and second cooperating members of the dispenser 2 are injection molded from a polystyrene material. In this regard, the molds for the dispenser 2 should be created to minimize the material used while providing sufficient structural integrity for the dispenser 2 to maintain its shape and not deflect to the point of opening inadvertently under normal conditions.

Variations, modifications and alterations to the preferred embodiment of the present invention described above will make themselves apparent to those skilled in the art. All such changes are intended to fall within the spirit and scope of the present invention, limited solely by the appended claims.

Any and all patents and/or patent applications referred to herein are hereby incorporated by reference.

We claim:

1. A razor cartridge dispenser for retaining, dispensing and receiving razor cartridges, the razor cartridges having a blade portion mounted to a handle connection portion, the dispenser comprising first and second cooperating members each comprising side walls and a connection member element, the connection member elements cooperating to join the first and second cooperating members such that the first and second cooperating members can be adapted from a closed configuration to an open configuration, each of said first and second cooperating members further comprising one or more compartments of substantially the same size and configuration to receive a said razor cartridge with each compartment comprising one or more catches to retain a said razor cartridge in said compartment, wherein when the cooperating members are in an open configuration the handle connection portions of razor cartridges retained in the compartments extend beyond the side walls and when the cooperating members are in a closed configuration the handle connection portion of a said razor cartridge retained in the first cooperating member nests within the side walls of the second cooperating member while the handle connection portion of a said razor cartridge retained in the second cooperating member nests within the side walls of the first cooperating member.

2. The razor cartridge dispenser of claim 1 wherein the connection member elements comprise one or more hinge elements to form one or more hinges.

3. The razor cartridge dispenser of claim 2 wherein the one or more hinges are disposed substantially perpendicular to the direction of the blades of the handle connection portion of each of the razor cartridges.

4. The razor cartridge dispenser of claim 2 wherein the one or more hinges extend across the entire width of the dispenser and have rounded surfaces when the dispenser is in the open configuration.

5. The razor cartridge dispenser of claim 4 wherein at least one of the cooperating members has one or more ramped wall on a side wall in the area of the hinge, the ramped wall extending in height to substantially a height of the hinge when the dispenser is in the open configuration.

6. The razor cartridge dispenser of claim 1 further comprising a closure member for maintaining the dispenser in its closed configuration.

7. The razor cartridge dispenser of claim 6 wherein the closure member comprises a release element.

8. The razor cartridge dispenser of claim 1 wherein at least one of the one or more compartments comprises a front wall and a rear wall having a top surface, wherein a front of the blade portion of the razor cartridge rests adjacent the front wall and at least a portion of the handle connection portion of the razor cartridge rests on the top surface of the rear wall.

9. The razor cartridge dispenser of claim 1 wherein at least one of the one or more compartments comprises one or more floor supports on which at least a portion of the blade portion of the razor cartridge rests.

10. The razor cartridge dispenser of claim 1 wherein at least one catch is associated with a side wall of the compartment.

11. The razor cartridge dispenser of claim 1 wherein at least one catch comprises at least one cammed lug at a free end of a spring arm associated with the side wall of the compartment.

12. The razor cartridge dispenser of claim 11 wherein the cammed lug includes a cammed surface on each of a top and a bottom surface of the lug.

13. The razor cartridge dispenser of claim 1 wherein the total interior height of the dispenser in the closed configuration is less than a total height of the two razor cartridges.

14. The razor cartridge dispenser of claim 13 wherein the total interior height of the dispenser is about a height of two of the blade portions and one handle connection portion of the razor cartridge.

15. The razor cartridge dispenser of claim 1 wherein the compartments on the second cooperating member are oriented a direction opposite an orientation of the compartments on the first cooperating member when the dispenser is in the closed configuration, so that the orientation of the compartments are the same when the dispenser is in the open configuration.

16. The razor cartridge dispenser of claim 1 wherein the number of compartments on the first cooperating member and the number of compartments on the second cooperating member are the same.

17. The razor cartridge dispenser of claim 1 wherein the compartments on the first and second cooperating members are arranged in columns or rows.

18. The razor cartridge dispenser of claim 1 wherein the first and second cooperating members have substantially the same length and width dimensions so as to form a clamshell configuration when the dispenser is in the closed configuration.

19. The razor cartridge dispenser of claim 1 further comprising one or more drain or ventilation holes in at least one of the first and second cooperating members.

* * * * *